US005897143A

United States Patent [19]

Baaqeil

[11] Patent Number: 5,897,143

[45] Date of Patent: Apr. 27, 1999

[54] METHOD OF INDEXING A BOOK

[76] Inventor: Hassan Baaqeil, Old Airport Road P.O. Box 22015, Riyadh, 11495, Saudi Arabia

[21] Appl. No.: 08/581,609

[22] PCT Filed: May 16, 1994

[86] PCT No.: PCT/IB94/00107

§ 371 Date: May 30, 1996

§ 102(e) Date: May 30, 1996

[87] PCT Pub. No.: WO95/31340

PCT Pub. Date: Nov. 23, 1995

[51] Int. Cl.[6] ..... B42F 21/00

[52] U.S. Cl. ..... 283/36; 283/41; 283/42; 283/67

[58] Field of Search ..... 283/36, 41, 42, 283/67; 40/124.1

[56] References Cited

U.S. PATENT DOCUMENTS 1,404,541 1/1922 Parsons .
1,743,274 1/1930 Hutchings .
2,135,708 11/1938 Gillette .
3,959,904 6/1976 Holliday .
4,085,534 4/1978 Eckstein et al. .
4,232,463 11/1980 Spees .
4,444,314 4/1984 Jacobsson .
4,571,867 2/1986 Williams .
4,614,450 9/1986 Neiman .
4,871,218 10/1989 Swinson .
4,927,178 5/1990 Schechter .
4,932,683 6/1990 Perazza .
4,949,999 8/1990 Ke-hui .

*Primary Examiner*—Frances Han
*Attorney, Agent, or Firm*—Quirk & Tratos

[57] ABSTRACT

A new way of citing pages in an alphabetically indexed printed reference material such as dictionaries and thesauruses. It implement a structured method for locating items in those materials and reduces the number of tasks and the frustration involved. This new way involve dividing the reference material into sections. Each section is divided into sub-sections (group of pages). Each page will have two header items (words) indexing range of the items (words) located in the page. The pages in the sub-section is sited so that the header items of each page is just above the header items of the previous page. Locating a word in done through two or three steps. First locating the section, then locating the sub-section (whenever applicable), and finally locating the page. This is done by browsing the header items (words) on each page.

10 Claims, 2 Drawing Sheets

METHOD OF INDEXING A BOOK

FIELD OF INVENTION

The invention is applicable to the field of alphabetically indexed printed references. The obvious example of those references and for which this invention will be most applicable are dictionaries and thesauruses. The invention changes the standard method of arranging the pages of those reference materials in such a way that accessing the page which contains the items (words, articles, etc.), such as locating a certain word in a dictionary, will be less frustrating and requires less steps.

BACKGROUND ART

The current method commonly used to layout alphabetically indexed printed references such as dictionaries and thesauruses requires certain steps for a user to look-up an item of interest. This method can become frustrating and time consuming. The invention attacks this problem and simplifies the way the item will be located. This is done by changing the method the pages are sited in those printed references.

DISCLOSURE OF INVENTION

Figure 1:
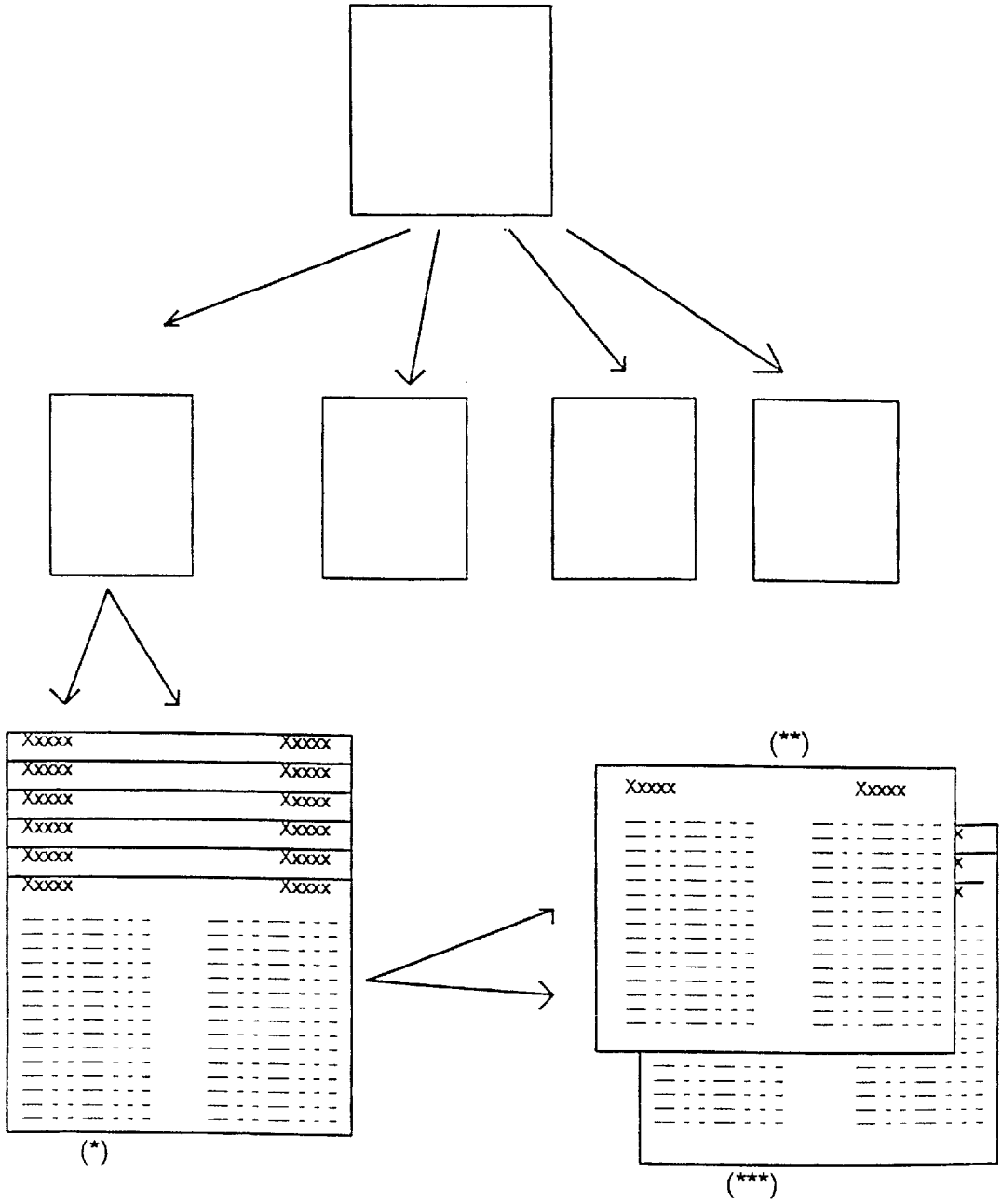
FIGS. 1 and 2 illustrate the book and method according to the present invention.

The invention introduces a new method of looking up words (item) in an indexed reference material. It does that by eliminating the time and efforts needed to locate the page of the reference material the word (item) is located at. This method modifies the way the reference material pages are placed. The pages are sited in such a way that by using the header words (indexes) of each page of the reference material a user can locate the page of the word he is looking-up with less efforts.

The invention does not implement a new method in the layout of the page or the layout of the words in the page itself. It requires a standard method of page layout that many reference materials are already using. This method (invention) requires that each page of the reference material has two header words (indexes). One of the words is located at the left topmost portion of the page and the other word is located at the right topmost portion of the page. The word on the left will index the first word that page includes and the word on the right indexes the last word that page includes. The only requirement this invention requires is that the two index words of the page should be placed (printed) on the topmost portion of the page. The top margin of the page should be as small as possible.

The invention is to divide the reference material into sections with each section divided into a number of sub-sections (group of pages). Starting from the second page of the first section or subsection page, all pages in the sub-section should be sited just above the preceding page so that the header words (indexes) of each page will appear just above the header words (indexes) of the preceding page and can be used to locate the words in the page.

All the user has to do is flip to the section the word (item) is located within by browsing the header words (indexes) of the pages and then flipping to the page that contains the word he is searching for.

BEST MODE FOR CARRYING OUT THE INVENTION

This mode requires that pages of the reference material, for example a dictionary 8, be grouped into limited number of sections, preferably four or five sections; depending on the number of the total pages. Each section 10 (group of pages) will be divided into sub-sections 12.

The first page 14 of the sub-section 12 is considered a header page. The rest of the pages of the sub-section should be sited according to the following: each page starting from the third page of this subsection will be sited in a way that the header words 16 (indexes) of a certain page will appear just above the header words of the previous page.

All sub-section pages except the first or header page, should be attached and sited behind the header page 14 of the sub-section 12 in a way that the top of the header page will be higher than any subsequent page of that sub-section.

The header page 14 of a sub-section will serve as an index to the subsection 12. Now each sub-section page IS will be attached together and sited so that the top of the sub-section header page will show a just above the header page of the preceding sub-section in away that the header words 16 (indexes) of each subsection header page appear just above the header words 16 (indexes) of the previous sub-section header page. All this is done for all the sub-sections of all sections of the reference material.

What a user will do to locate a word (an item) in the reference material is as follows. First, locate the section the word is at and flip (turn) to that section. Second, the user needs to locate which subsection within which the word is located. All he has to do is to scan the header page of each sub-section, using the header words (indexes). Third, is to locate the page of the sub-section that contain the word he is looking-up. So, once he locates the sub-section he should flip to that sub-section by turning its header page to the left. Then he can browse (scan) the header words (indexes) on the pages with that sub-section. The final step is to flip to the page that contains the word he wants.

OTHER MODE FOR CARRYING OUT THE INVENTION

Figure 2:
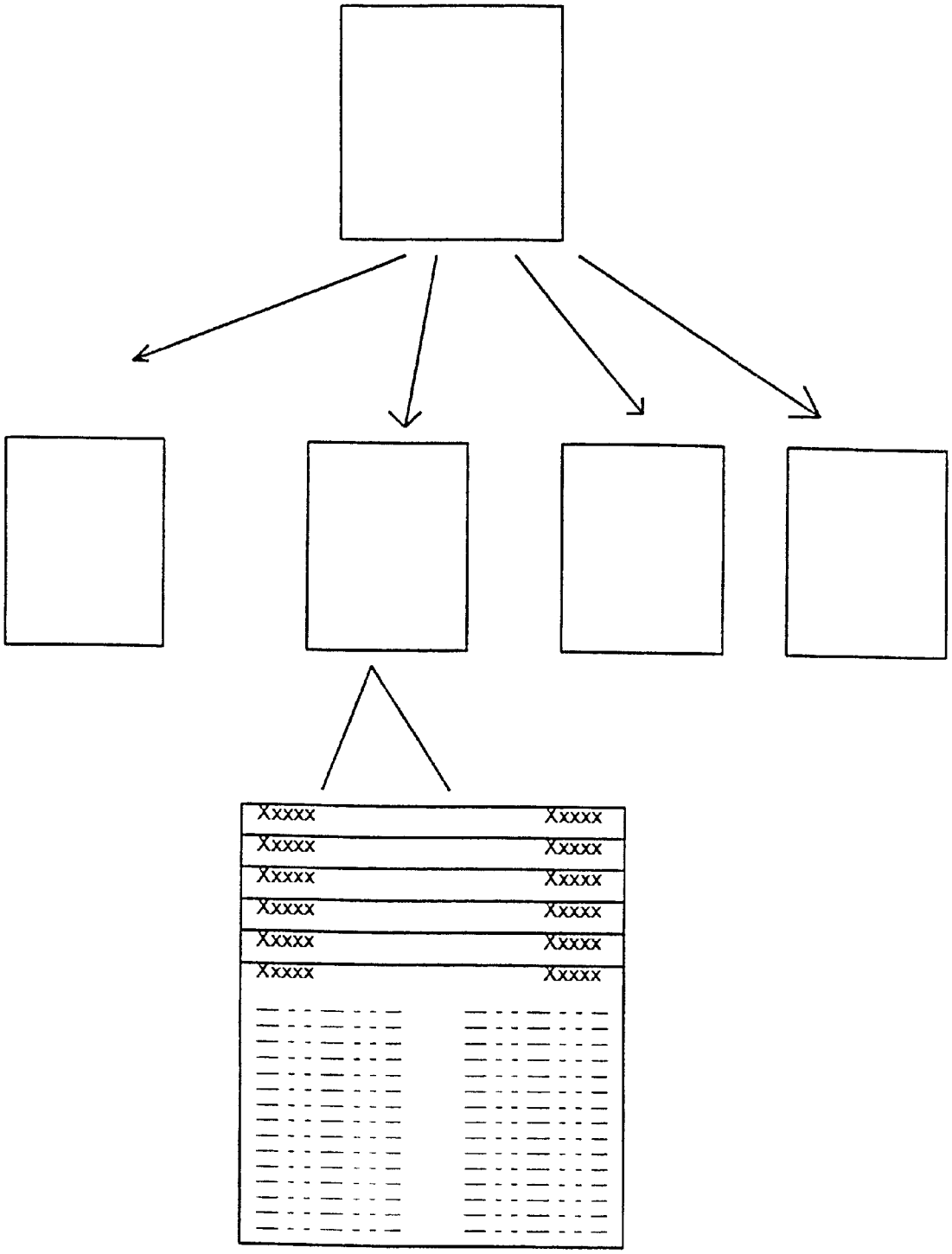

This mode will work well for medium size or pocket indexed reference material (such as pocket dictionaries). The reference material will be grouped into four or five sections (group of pages). No sub-sections will be needed (see FIG. 2).

At each section 10, starting from the second page each page 18 will be placed a just above the preceding page so that the header words 16 (indexes) in any page will appear the header words of the previous page.

This method will increase the height of the reference material by almost double. All the user have to do to locate a word is at, then by browsing the header words 16 (indexes) on each page 18 of the section 10 he can locate the page the word is located at.

I claim:

1. A reference book arranged for rapid location of items therein, the items laid out in alphabetical or hierarchical fashion on the pages of the book, comprising:

section header means located on at least two pages of said book, said section header means dividing the book into sections of a number of pages within a section, the pages within each section arranged such that the top of each page within a section is located slightly above the preceding page when the pages of the section are closed together; and page header means located on the top of each page in each section, said page header means identifying items from a first listing to a last listing for the page located on the page on which the header means are located, said page header means viewable when the pages for the section are closed together.

2. The book of claim 1, wherein the pages within said sections are divided into subsections, the first page of each subsection located above and covering the pages of the subsection, the first page of each section including sub-section header means, each sub-section header page of each section located above the preview subsection header page in that section.

3. The book of claim 1, wherein the page header means comprises items listed at a top left portion and a top right portion of said page.

4. A method for arranging items in a reference book comprising:

dividing the pages of the book into sections;

providing a label identifying the contents of each section;

arranging pages within each section such that the top portion of succeeding pages are above a top portion of the previous page when the pares of the section are closed together;

providing a label on the top portion of each page which identifies the contents of each page from a first to a last item listing for that page, said page top portions and labels arranged such that said labels are viewable when the pages of the section are closed together.

5. The method of claim 4, further including the step of arranging pages within each section into subsections, the first page of each subsection located over the pages therein, with the first page of each subsection arranged such that a top portion thereof is above a top portion of the preceding first page of a subsection.

6. The method of claim 5, further including the step of providing subsection labels.

7. A reference book arranged for rapid location of items therein, the items laid out in alphabetical or hierarchical fashion on the pages of the book, comprising:

headers to divide the book into item sections, each section including a plurality of pages and each page containing an item listing from a first to a last entry for each page;

pages of each section including a margin extending slightly above the margin of the preceding page when the pages of the section are closed together; and each margin including indicia identifying the first and last entry for the page whereby for each section the item identifying indicia thereon are visible when the section pages are closed together.

8. A method for arranging items within a reference book comprising:

dividing the pages of the book into sections;

configuring pages within each section such that the margin of a page is above the margin of the preceding page when the pages of the section are closed together; and providing indicia on each page margin identifying the first and last items listed in that page, said page configuration displaying the indicia of the pages when the pages of the section are closed together.

9. The method of claim 8 including providing a section preview page as the first page of the section, separating each section into subsections having a header page with a margin configured to extend above the margin of the preceding subsection header page, and providing said indicia for the header page at the margin thereof whereby the subsection header page indicia is viewable with the pages of the section closed together.

10. A reference book arranged for rapid location of items therein, the items laid out in alphabetical or hierarchical fashion on the pages of the book, comprising:

a plurality of section dividers dividing the book into sections each containing a plurality of pages having thereon a description of items listed from a first to a last entry for each page, said dividers disposed to be displayed with the pages of the book are open or closed together;

pages within the section defining subsection header pages dividing the section into subsections;

each subsection header page having a margin to extend above the margin of the preceding subsection header page within the section when the pages of the subsections are closed together;

all pages including at their margin indicia identifying the first and last entry for the page; and the margins for the pages within the subsection extending above the margin of the preceding page such that the indicia for the pages within the subsection are displayed one above the other with the pages of the subsection closed together, the margins and indicia of the subsection header pages displayed one above the other with the pages of the section closed together.

* * * * *